United States Patent [19]

Liedke

[11] 4,174,654

[45] Nov. 20, 1979

[54] GAS-SEALING MEANS FOR TUBULAR MAGAZINE GAS-OPERATED FIREARM

[75] Inventor: Carl F. Liedke, North Haven, Conn.

[73] Assignee: O. F. Mossberg & Sons, Inc., North Haven, Conn.

[21] Appl. No.: 800,190

[22] Filed: May 25, 1977

[51] Int. Cl.[2] ..... F41C 5/02

[52] U.S. Cl. ..... 89/191 A

[58] Field of Search ..... 89/191 A

[56] References Cited

U.S. PATENT DOCUMENTS

| | | | |
|---|---|---|---|
| 3,657,960 | 4/1972 | Badali | 89/191 A |
| 3,945,296 | 3/1976 | Hyytinen | 89/191 A |

*Primary Examiner*—Stephen C. Bentley

*Attorney, Agent, or Firm*—St. Onge, Mayers, Steward & Reens

[57] ABSTRACT

A gas-sealing device for gas-operated firearms of the tubular-magazine type in which a pair of radially flexible piston-rings are provided for sealing the gases within the annular chamber between the gas cylinder and the magazine tube. Each piston-ring is provided with a gas-impingement surface so disposed that the pressure of the gases in the gas chamber against such impingement surfaces forces one of the rings outward into sealing engagement with the walls of the cylinder and the other inward into sealing engagement with the magazine tube.

4 Claims, 4 Drawing Figures

GAS-SEALING MEANS FOR TUBULAR MAGAZINE GAS-OPERATED FIREARM

BACKGROUND OF THE INVENTION

The present invention relates to gas-operated, tubular-magazine firearms, such as shotguns, in which an annular piston encircling the magazine reciprocates within a cylinder surrounding a portion of the magazine for actuating the bolt-mechanism when the gun is fired. The invention more particularly relates to means for sealing the piston inwardly with the outer surface of the magazine, as well as outwardly with the walls of the cylinder.

Gas-operated shotguns of the type referred to above have been in commercial use for many years. United States patent to Hillberg U.S. Pat. No. 2,909,101 shows the general arrangement of an annular piston, a magazine tube and a short gas cylinder located at a predetermined distance from the cartridge chamber for handling a wide range of different-powered shot shells in any gauge. One of the difficulties with the Hillberg design is that the annular piston must have a gas-tight fit with the magazine tube on which it slides and therefore requires close manufacturing tolerances in order to maintain concentricity and alignment between the piston and magazine tube over the full distance through which the piston travels with the action of the gun. Any out-of-roundness of the magazine or other deformation results in binding of the annular piston.

One solution to the problems encountered in the Hillberg design is illustrated in the United States patent to Kelly et al U.S. Pat. No. 3,200,710, which shows a gas system similar to that of Hillberg, but with the gas-sealing portion of the annular piston separated from the rest of the piston so that it travels only a short distance toward the receiver after leaving the cylinder, thereby making it necessary to provide a gas-tight fit with the magazine tube only in the short portion that is surrounded by the cylinder. This design is employed in the well-known Remington Model 1100 autoloading shotgun manufactured for many years by Remington Arms Company, Inc. of Bridgeport, Connecticut. As actually produced, however, the two rings that make up the separate gas-sealing portion of the piston are both split, so that as the so-called piston is driven rearwardly against the piston-sealing ring, it wedges this ring outward into sealing engagement with the walls of the gas cylinder and at the same time is itself squeezed inwardly by the mating wedging surfaces into sealing engagement with the magazine tube.

In the United States patent to Beretta U.S. Pat. No. 3,420,140 a short-stroke piston in front of the magazine tube engages a reciprocating sleeve which surrounds the magazine. The principal objection to this arrangement is that the magazine tube must be shortened in order to locate the gas port at the required distance from the cartridge chamber for handling both low and high-power ammunition. Alternatively, if a full-length magazine is used, the gas cylinder must be positioned so far from the cartridge chamber that only high-power shells can be used due to the fact that insufficient energy is imparted to the piston to function the gun properly when low-power shells are fired.

U.S. Pat. Nos. 3,568,564 and 3,657,960 to Badali disclose a short-stroke annular piston around the magazine tube which actuates the breech-bolt mechanism by means of a push-rod attached to a sleeve that slides on the magazine and at the same time telescopes into the annular piston. A split sealing ring interposed between the end of the sleeve and a flange at the front of the piston is provided with a beveled face against which the piston presses when it is driven rearward by the combustion gases in the cylinder, flexing the sealing ring inward into sealing engagement with the magazine tube. Conventional piston sealing rings are employed for sealing the outer surface of the piston with the inner walls of the cylinder.

Means for sealing an annular piston within an annular gas chamber like that employed in the Remington Model 1100 is shown in United States patent to Janson U.S. Pat. No. 3,601,002. In the Janson patent a radially flexible sleeve is loosely attached to the front of the piston so that it can move longitudinally thereof into engagement with an internal sealing ring for wedging the ring into sealing engagement with the magazine, such wedging action causing the sleeve to flex outward into sealing engagement with the walls of the cylinder.

Still another design in which an annular piston is slidably mounted on the tubular magazine of an autoloading shotgun is shown in United States patent to Zanoni U.S. Pat. No. 3,848,511. In this case conventional sealing rings are provided for preventing leakage of gas from the cylinder during the power stroke.

An object of the present invention is to provide satisfactory sealing of the annular piston both inwardly against the magazine tube and outwardly against the walls of the cylinder without the need for providing precise alignment and concentricity of the piston with respect to both the magazine tube and the cylinder. Another object of the invention is to provide a gas-sealing device for an annular piston gas-powered system for autoloading firearms, in which the gas-seals are self-aligning both with respect to the magazine tube on which they are slidably mounted and with respect to the cylinder into which they may be inserted on return of the breech-bolt mechanism to its battery position. Still another object of the invention is to provide such a sealing device which does not employ frictional surfaces that wedge the gas-seals against the magazine tube or against the walls of the cylinder.

SUMMARY OF THE INVENTION

The invention resides basically in providing a pair of concentric piston rings which are slidably mounted on the magazine tube at the front of the annular piston or other annular member, against which such rings are driven by the pressure of the gases of combustion in the cylinder when a cartridge is discharged. Both rings are flexible in a radial direction, the inner one for contraction into sealing engagement with the magazine tube, and the outer one for expansion into sealing engagement with the walls of the cylinder. Such inward and outward flexing of the sealing rings is achieved in accordance with the present invention by providing a gas-impingement surface on each ring disposed in such a way that the pressure of the gases in the annular gas chamber is exerted outwardly against the outer ring and inwardly against the inner ring. In contrast with the sealing rings of the prior art, such for example as in the patent to Janson U.S. Pat. No. 3,601,002, neither of the sealing rings of the present invention must move longitudinally of the piston relative to the other in order to produce a mutual wedging action. Instead, both rings are acted on directly by the pressure of the gas in the annular chamber, forcing one ring inward and the other outward.

Desirably, the sealing rings of the present invention may be connected to the piston, inertial weight or other annual member, for movement therewith throughout the full reciprocating stroke of the breech-bolt. When the gas-pressure on the two rings is released, they spring back to their normal condition out of gas-sealing relation with the surfaces with which they seal when pressure is exerted on them by the combustion gases in the cylinder. Consequently, minor deformations in the surfaces of the magazine tube or misalignment of the cylinder with respect to the magazine do not cause the piston rings to bind with the magazine tube or within the cylinder as they return to battery position. In addition, the annular piston is loosely fitted on the magazine with adequate clearance to prevent binding and wear. Similarly, the outer surface of the piston is smaller in diameter than the inside diameter of the cylinder so that it fits freely therein. Sealing is therefore provided only when the sealing rings are flexed inwardly and outwardly by the pressure of the gases of combustion against their respective gas-impingement surfaces.

The invention is likewise advantageous where the sealing rings are separated from the piston so that they do not travel the full distance with the piston and may be prevented from leaving the cylinder by venting the cylinder after the piston has been driven far enough to provide sufficient inertia to function the breech-bolt mechanism properly. Suitable means for stopping the rings before they leave the cylinder can also be provided, thereby reducing wear on the lead-in chamfer at the opening of the cylinder as the piston and sealing rings return to their normal position within the cylinder.

An important advantage of the present invention is that unlike the split piston rings of the prior art, both the inner and outer rings are acted on directly by the pressure of the gases of combustion, thereby flexing one of the rings inward and the other outward without employing wedging surfaces which frictionally engage each other and consequently are subject to wear and binding.

DETAILED DESCRIPTION OF THE PREFERRED EMBODIMENTS

The invention is illustrated by way of example in the accompanying drawings wherein FIG. 1 is a partial view in side elevation of a shotgun in which the present invention is employed, portions thereof being illustrated schematically and with the operating parts shown in battery position;

Figure 1:
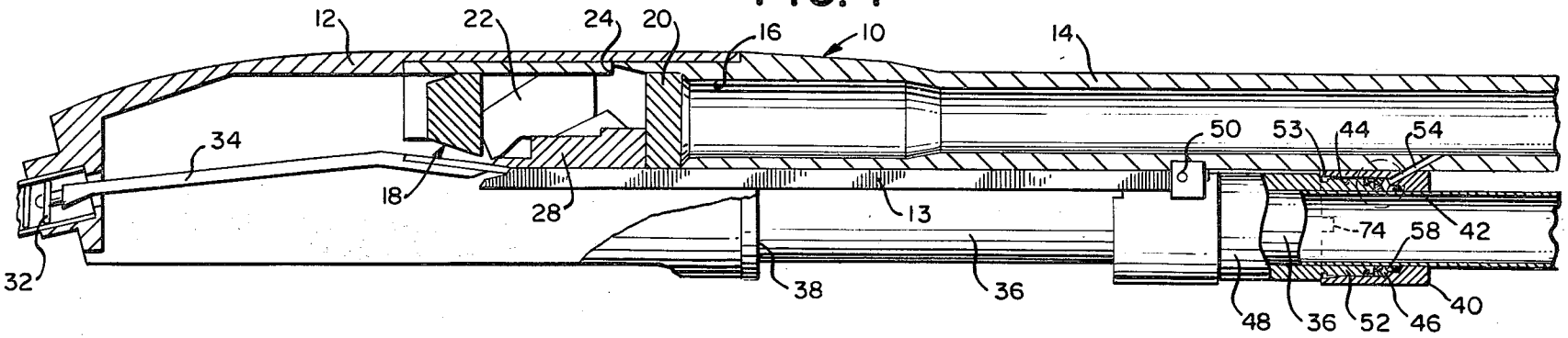

As shown in FIG. 1, a shotgun 10 includes a receiver 12 to which a barrel 14 is removably secured. A cartridge chamber 16, which receives a shell when the shotgun is loaded, is machined in the interior of barrel 14. A breech-bolt mechanism, generally indicated at 18, is reciprocally mounted in receiver 12 for actuation by a pair of action bars 13 (only one of which is shown), for movement in the usual manner between a battery position in which cartridge chamber 16 is closed and a retracted position at the rear of the receiver for loading a fresh cartridge into chamber 16. Bolt mechanism 18 includes a breech bolt 20 that houses a firing pin (not shown) to discharge a loaded shell. A tiltable bolt lock 22 is also mounted in the bolt and has a shoulder 24 formed to engage a notch disposed on the upper interior wall of the barrel extension. A stepped action-slide block 28, fixed to the reciprocally mounted action bars 13, controls tilting movement of the bolt-lock 22 to engage the shoulder 24 when the bolt 20 is locked and to disengage it when the bolt is unlocked.

The breech-bolt mechanism 18 is urged toward battery position by an action-return spring 32, housed in the stock (not shown). Spring 32 acts through an elongate link or strut 34 that engages the tail portions of action bars 13.

Shotgun 10 further includes a tubular magazine 36, one end 38 of which opens into receiver 12 and is permanently attached thereto. The other or front end of magazine 36 is closed by a magazine cap (not shown) in the usual manner. Fresh shells are inserted end-to-end into the receiver end 38 of the magazine for storage and subsequent automatic delivery to the receiver by a coil spring (not shown) compressed within the magazine.

The general operation of the gun as described so far is more or less conventional. While the bolt is held retracted, a shell is inserted into the cartridge chamber 16 and the bolt released to close and lock the action. After each shell is discharged, the bolt is moved rearward out of battery position to eject the spent casing. Simultaneously, a fresh shell is delivered from the magazine to the receiver by the magazine follower spring. When the bolt returns to battery position under the urge of action spring 32, it loads the fresh shell into the chamber.

Magazine tube 36 is supported adjacent its muzzle end by a cylinder housing 40 which is permanently fixed to the underside of the barrel 14. Cylinder 40 completely encircles tube 36 and is provided with a central opening 42 at its front or muzzle end through which tube 36 extends for sealing engagement therewith. Immediately in back of and concentric with opening 42 is an enlarged bore 44 which forms an annular gas-chamber 46 with the magazine tube 36. Gas-chamber 46 is closed at its front end but opens rearwardly toward the receiver 12. Between receiver 12 and cylinder 40 and slidably mounted on magazine tube 36 is an annular piston 48, which is connected adjacent its rear end by suitable means, including a pin 50, to the forward ends of action bars 13. The front or annular head 52 of piston 48 is reduced in diameter to fit within the bore 44 of cylinder 40 when the breech-bolt mechanism 18 is in battery position as shown in FIG. 1, the forwardly facing shoulder 53 of piston 48 providing a stop-surface which engages the rear end of cylinder 40 for limiting the forward movement of the cylinder head 52 into cylinder 40. A gas-port 54 is formed between the interior of barrel 4 and gas-chamber 46 for conducting the combustion gases in the barrel to the gas-cylinder each time a cartridge is fired.

Thus, on firing the gun, the pressure of the gases of combustion drive the piston 48 rearward, unlocking the bolt-lock 22 and then driving the bolt 18 rearward in the receiver for extracting the spent case and reloading the gun in the usual manner.

In order to ensure proper actuation of the breech-bolt mechanism, it is important to prevent leakage of gas from the gas-chamber 46 during the brief period when the piston 48 is within the cylinder 40. Accordingly, leakage forward between the magazine tube 36 and the opening 42 in cylinder 40 is prevented by a flexible O-ring 56 and a rigid sealing ring 58 slidably mounted on magazine tube 36 rearward of the O-ring 56. Thus, when the annular gas-chamber 46 is pressurized, ring 58 is driven forward against O-ring 56 which in turn seals the opening 42 of cylinder 40 with the magazine tube.

Of still more importance is the prevention of leakage of gases rearward past the piston head 52. To this end, it is of course necessary to seal the piston head 52 both outwardly against the inner walls of bore 44 and inwardly against the outer surface of magazine tube 36. As hereinbefore mentioned, it is not practical to seal the annular piston by precisely machining the parts. Consequently, the outside diameter of the cylinder head 52 is formed to provide enough clearance between it and the walls of cylinder 40 to allow the piston to center itself both inwardly with respect to the magazine tube and outwardly with respect to the cylinder. In this connection, it is of course also necessary to provide clearance between the inside diameter of the annular piston and the outer surface of the magazine tube. In practice it has been found that approximately 0.010 inch clearance should be provided between the outer surface of cylinder head 52 and the bore of cylinder 40, while about 0.007 inch should be provided between the inner surface of piston 48 and the outer surface of tube 36.

It will be appreciated therefore that with clearances of this magnitude, it is essential to provide means for sealing the piston with the inner and outer walls of the annular gas-chamber 46. In accordance with the teaching of the prior art, as represented by the aforementioned Remington Model 1100 autoloading shotgun and the patent to Janson U.S. Pat. No. 3,601,002, such sealing has been achieved heretofore by means of a pair of split sealing rings, one of which wedges the other in one direction radially while being forced in the opposite direction by such wedging action for sealing the other surface.

Figure 2:
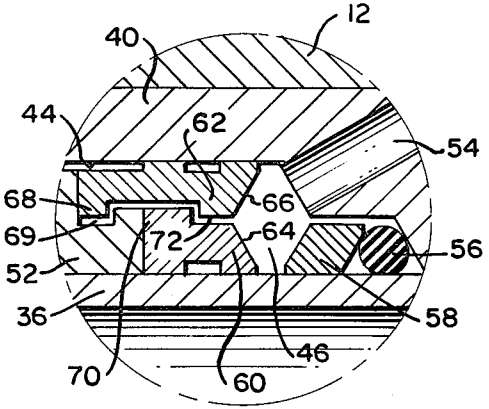
FIG. 2 is an enlarged detail view of the circled area shown in FIG. 1.

In accordance with the present invention, however, a pair of concentric sealing rings is provided which are not wedged into sealing engagement with the inner and outer walls of the annular gas-chamber, but instead are both flexed directly by the pressure of the gases in the chamber radially inward and outward to form the desired seals with the walls of the annular chamber. Thus, as best shown in FIG. 2, an inner piston ring 60 is provided in front of piston head 52 for sealing engagement with magazine tube 36, and an outer piston ring 62 is provided radially outward of ring 60 for sealing with the inner walls of cylinder bore 44. Both rings 60 and 62 are split so that they are free to flex radially. Inner ring 60 has an outwardly facing (in this case bevelled) surface 64 against which the gases in chamber 46 impinge, forcing ring 60 radially inward against tube 36 as well as rearwardly against the end of annular piston head 52. Outer ring 62, on the other hand, is provided with an inwardly facing impingement surface 66 against which the gas pressure is exerted, thereby forcing ring 62 both rearwardly against piston head 52 and outwardly into sealing engagement with the walls of cylinder bore 44.

For the sake of preventing binding between rings 60,62 and the walls of the annular chamber 46 in which they work, it has been found desirable to provide a small amount of clearance radially (on the order of from 0.005 and 0.011 inch) between the two concentric piston rings to allow for any eccentricity between the opening 42 in which magazine tube 36 is supported and the bore 44. In the normal or relaxed condition of piston ring 60 sufficient clearance is provided between it and magazine tube 36 to allow it to slide freely thereon without engaging it tightly enough to bind or cause undue wear. However, when the gases of combustion from the explosion of a shot shell enter gas-chamber 46, piston ring 60 is flexed inwardly by the pressure of the combustion gases against impingement surface 64 into sealing engagement with the tube 36. Immediately upon venting of the gases to the atmosphere as piston 48 is driven rearward, ring 60 returns to its normal condition so that it no longer sealingly engages magazine tube 36 and can therefore travel with the piston without binding.

Similarly, outer piston ring 62 normally only lightly engages the bore 44 of cylinder 40 but is flexed outwardly by the pressure of the gases combustion against impringement surface 66 into sealing engagement with cylinder 40 during the power stroke, immediately relaxing inward again into its normal condition as soon as the gas-chamber 46 is vented. Consequently, as the piston returns to its forward or battery position, outer piston ring 62 enters the cylinder bore 44 smoothly without danger of being tilted or of binding within the cylinder. In order to allow for greater manufacturing tolerances which could result in limited eccentricity between the bore 44 and the magazine tube 36, the outer end of the cylinder bore should be provided with an internal lead-in chamfer which causes the outer piston ring 62 to align itself properly within the cylinder bore, such self-alignment being allowed for by the radial clearance between the two rings.

Piston rings 60 and 62 are resiliently attached to the forward end of piston 48, so that they travel therewith throughout its full stroke. To this end, outer ring 62 is provided with a skirt portion which extends rearward of the inner ring and has an inwardly projecting flange 68 which engages within a circumferential groove 69 formed in the periphery of piston head 52 just rearward of the forward extremity of the piston. Inner piston ring 60, on the other hand, has an outwardly projecting flange 70 which mates with a corresponding inner flange 72 at the front edge of outer ring 62. Inner ring 60 is therefore trapped between the face of piston head 52 and flange 72 so that it moves with the piston throughout its full stroke. Since piston rings 60 and 62 are flexible radially, they can be readily snapped into and out of assembly with each other and with the piston head 52 for disassembly and cleaning purposes.

Figure 4:
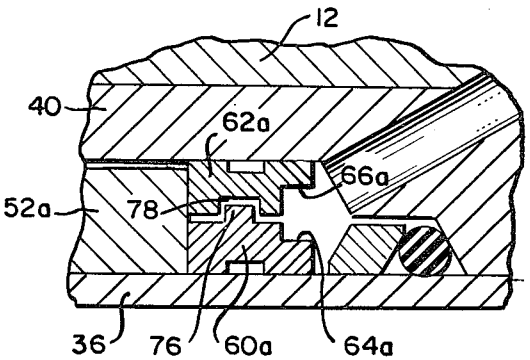
FIG. 4 is a detail view similar to FIG. 2, but showing a modified form which the piston rings may take.

As shown in broken lines in FIG. 1, the rear edge of cylinder 40 may be provided with a bleed-off notch 74 on each side of a vertical plane through the center of the cylinder. This allows the gases in the gas-chamber 46 to be bled off before piston rings 60 and 62 actually leave the cylinder. It will also be apparent that the piston rings of the present invention need not be attached to piston 48, but can be separate therefrom so that they do not travel with the piston throughout its full stroke. Thus, as shown in FIG. 4, the piston rings **60*a* and 62*a* are mounted so that they are free to separate from the head 52*a* of the piston as the piston moves rearward out of the bore of cylinder 40**.

Figure 3:
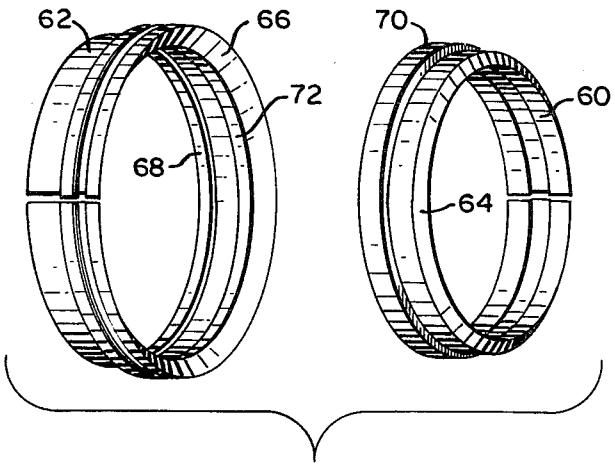
FIG. 3 is a perspective view of the piston rings shown in FIGS. 1 and 2, the rings being shown separated from each other.

In addition, the configuration of impingement surfaces on the piston rings may vary. For example, instead of being conical as shown in FIGS. 1–3, they may be undercut to form inwardly facing cylindrical surfaces **64*a* and 66*a*, respectively, against which the gas pressure is exerted to force the ring 60*a* inward into sealing engagement with magazine tube 36**, while forcing ring 62*a* outward into sealing engagement with the walls of cylinder 40. In this case ring 60*a* is provided with an outer circumferential rib 76 which mates with an inner groove 78 in ring 62*a* for maintaining these rings in telescoping relation to each other. It will be apparent moreover that where the sealing rings are separated from the piston as in FIG. 4, they can be prevented from moving completely out of cylinder 40 as soon as bleed-off notch 74 is uncovered.

What is claimed is:

1. In a gas-operated autoloading firearm having a receiver, a barrel, a tubular magazine mounted beneath and parallel to said barrel, a gas cylinder fixed to said barrel and surrounding a portion of said magazine, said cylinder and magazine defining an annular gas-chamber closed at the end nearest the muzzle of the barrel, an annular member slidably mounted on said magazine for reciprocal movement axially thereof and normally disposed within said annular chamber, and a gas port connecting said barrel and chamber adjacent the closed end thereof, a gas-sealing device for preventing leakage of gas from said chamber during the power-stroke of said annular member on pressurization of said annular chamber by gas in said barrel when a cartridge is discharged, said gas-sealing device comprising a radially flexible inner piston-ring slidably mounted on said magazine forward of said annular member for sealing engagement with said magazine and having a gas-impingement surface facing said chamber, a radially flexible outer piston-ring disposed radially outward of said inner piston-ring for sealing engagement with the inner walls of said cylinder and having a gas-impingement surface facing said chamber, said gas-impingement surfaces on said inner and outer piston-rings facing outwardly and inwardly, respectively, relative to each other such that the pressure of the gas in said annular chamber acting directly on said gas-impingement surfaces flexes said inner piston-ring into sealing engagement with said magazine while flexing said outer piston-ring into sealing engagement with said cylinder, one of said piston-rings being connected to said annular member and to the other of said piston-rings such that said piston-rings move continuously with said annular member throughout its reciprocal movement.

2. In a gas-operated autoloading firearm having a receiver, a barrel, a tubular magazine mounted beneath and parallel to said barrel, a gas cylinder fixed to said barrel and surrounding a portion of said magazine, said cylinder and magazine defining an annular gas-chamber closed at the end nearest the muzzle of the barrel, an annular member slidably mounted on said magazine for reciprocal movement axially thereof and normally disposed within said annular chamber, and a gas port connecting said barrel and chamber adjacent the closed end thereof, a gas-sealing device for preventing leakage of gas from said chamber during the power-stroke of said annular member on pressurization of said annular chamber by gas in said barrel when a cartridge is discharged, said gas-sealing device comprising a radially flexible inner piston-ring slidably mounted on said magazine forward of said annular member for sealing engagement with said magazine and having a gas-impingement surface facing said chamber, a radially flexible outer piston-ring disposed radially outward of said piston-ring for sealing engagement with the inner walls of said cylinder and having a gas-impingement surface facing said chamber, said gas-impingement surfaces on said inner and outer piston-rings being bevelled inwardly toward each other so that they face outwardly and inwardly, respectively, such that the pressure of the gas in said annular chamber acting directly on said gas-impingement surfaces flexes said inner piston-ring into sealing engagement with said magazine while flexing said outer piston-ring into sealing engagement with said cylinder.

3. In a gas-operated autoloading firearm having a receiver, a barrel, a tubular magazine mounted beneath and parallel to said barrel, a gas cylinder fixed to said barrel and surrounding a portion of said magazine, said cylinder and magazine defining an annular gas-chamber closed at the end nearest the muzzle of the barrel, an annular member slidably mounted on said magazine for reciprocal movement axially thereof and normally disposed within said annular chamber, and a gas port connecting said barrel and chamber adjacent the closed end thereof, a gas-sealing device for preventing leakage of gas from said chamber during the power-stroke of said annular member on pressurization of said annular chamber by gas in said barrel when a cartridge is discharged, said gas-sealing device comprising a radially flexible inner piston-ring slidably mounted on said magazine forward of said annular member for sealing engagement with said magazine and having a gas-impingement surface facing said chamber, a radially flexible outer piston-ring disposed radially outward of said piston-ring for sealing engagement with the inner walls of said cylinder and having a gas-impingement surface facing said chamber, said gas-impingement surfaces on said inner and outer piston rings being outwardly and inwardly facing cylindrical surfaces, respectively, such that the pressure of the gas in said annular chamber acting directly on said gas-impingement surfaces flexes said inner piston-ring into sealing engagement with said magazine while flexing said outer piston-ring into sealing engagement with said cylinder.

4. In a gas-operated autoloading firearm having a receiver, a barrel, a tubular magazine mounted beneath and parallel to said barrel, a gas cylinder fixed to said barrel and surrounding a portion of said magazine, said cylinder and magazine defining an annular gas-chamber closed at the end nearest the muzzle of the barrel, an annular member slidably mounted on said magazine for reciprocal movement axially thereof and normally disposed within said annular chamber, and a gas port connecting said barrel and chamber adjacent the closed end thereof, a gas-sealing device for preventing leakage of gas from said chamber during the power-stroke of said annular member on pressurization of said annular chamber by gas in said barrel when a cartridge is discharged, said gas-sealing device comprising a radially flexible inner piston-ring slidably mounted on said magazine forward of said annular member for sealing engagement with said magazine and having a gas-impingement surface facing said chamber, a radially flexible outer piston-ring disposed radially outward of said piston-ring for sealing engagement with the inner walls of said cylinder and having a gas-impingement surface facing said chamber, said gas-impingement surfaces on said inner and outer piston rings facing outwardly and inwardly, respectively, relative to each other such that the pressure of the gas in said annular chamber acting directly on said gas-impingement surfaces flexes said inner piston-ring into sealing engagement with said magazine while flexing said outer piston-ring into sealing engagement with said cylinder, said piston-rings being separate from said annular member for movement into driving engagement with said annular member under the pressure of gases in said gas-chamber and for separation therefrom upon release of said pressure.

* * * * *